US006996352B2

(12) United States Patent
Choi et al.

(10) Patent No.: US 6,996,352 B2
(45) Date of Patent: Feb. 7, 2006

(54) GAS EXHAUSTING APPARATUS FOR WET ELECTROPHOTOGRAPHIC IMAGE FORMING DEVICE AND METHOD THEREOF

(75) Inventors: Joong-hwan Choi, Seoul (KR); Jeong-hun Pang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 75 days.

(21) Appl. No.: 10/712,319

(22) Filed: Nov. 14, 2003

(65) Prior Publication Data

US 2004/0105697 A1 Jun. 3, 2004

(30) Foreign Application Priority Data

Dec. 3, 2002 (KR) ..... 10-2002-0076365

(51) Int. Cl.
*G03G 21/20* (2006.01)

(52) U.S. Cl. ..... 399/93

(58) Field of Classification Search ..... 399/91, 399/92, 93, 98, 320
See application file for complete search history.

(56) References Cited

U.S. PATENT DOCUMENTS 4,202,618 A * 5/1980 Waschk et al. ..... 399/93
4,415,533 A * 11/1983 Kurotori et al. ..... 399/93 X
4,666,282 A * 5/1987 Rowe ..... 399/93
5,047,798 A * 9/1991 Yamamoto et al.
5,371,577 A * 12/1994 Fujimura et al. ..... 399/93
5,946,528 A * 8/1999 Cho ..... 399/93
6,041,201 A * 3/2000 Kim ..... 399/93
6,094,549 A * 7/2000 Hiraoka et al. ..... 399/93
6,339,688 B1 * 1/2002 Cho et al. ..... 399/93
6,577,828 B1 * 6/2003 Ramos ..... 399/93

* cited by examiner

*Primary Examiner*—Sandra L. Brase
(74) *Attorney, Agent, or Firm*—Staas & Halsey LLP

(57) ABSTRACT

A gas exhausting apparatus for use in a wet electrophotographic image forming device includes an exhaust duct, an exhaust fan, and an air purification unit. The exhaust duct forms an air flow passage from an inside of a device to an outside of the device. The exhaust fan inhales air from the inside of the device through the exhaust duct and exhausting the air through the exhaust duct to the outside of the device. The air purification unit removes impurities included in the air inhaled by the exhaust fan. The exhaust duct includes: a first inhalation guide formed to inhale and guide impurity-containing high temperature air in the printer and having the air purification unit disposed therein to pass the impurity-containing air through the air purification unit; a second inhalation guide formed to inhale and guide non-impurity-containing air of room temperature in the printer; and an exhaust guide formed to communicate with the first inhalation guide and the second inhalation guide and having the exhaust fan disposed therein to mix the impurity-containing air and the non-impurity-containing air respectively inhaled through the first inhalation guide and the second inhalation guide and then exhaust the impurity-containing air and the non-impurity-containing air to the outside of the device.

12 Claims, 3 Drawing Sheets

GAS EXHAUSTING APPARATUS FOR WET ELECTROPHOTOGRAPHIC IMAGE FORMING DEVICE AND METHOD THEREOF

CROSS-REFERENCE TO RELATED APPLICATIONS

This application claims the benefit of Korean Application No. 2002-76365, filed Dec. 3, 2002, in the Korean Intellectual Property Office, the disclosure of which is incorporated herein by reference.

BACKGROUND OF THE INVENTION

1. Field of the Invention

The present invention generally relates to a gas exhausting apparatus of wet electrophotographic image forming device, and more particularly, it relates to a gas exhausting apparatus of wet electrophotographic image forming device which is capable of oxidizing and thermally decomposing impurities such as combustible hydrocarbon ($C_mH_{2n}$) etc. included in a gas generated when a toner image transferred on a sheet of paper is fused by heat and pressure, and then exhausting the gas.

2. Description of the Related Art

Generally, an electrophotographic image forming device such as color laser printer uses a liquid toner including a carrier solution of a hydrocarbon system such as, for example, a compound of $C_{10}H_{22}$, $C_{11}H_{24}$, $C_{12}H_{26}$ and $C_{13}H_{28}$, a pigment, etc., as a developer for printing. Almost all of the carrier solution included in such a liquid toner is withdrawn into a developer storing unit during the processes of developing a toner image onto a photosensitive body through a developing roller, and transferring the toner image formed on the photosensitive body onto a transfer belt, but a portion of the carrier solution still remains in the toner image until fusing or a fusing/transferring operation. During the fusing or the fusing/transferring operation, the toner image is fused or fixed on a sheet of paper by a pressing roller and a heating roller of a fusing unit . During this operation, the part of the carrier solution remaining in the toner image evaporates. This evaporation generates a combustible hydrocarbon gas by the heat radiated by the pressing roller and the heating roller . This gas is then exhausted to the outside.

However, the combustible hydrocarbon gas generated due to evaporation of the carrier solution is a volatile organic compound (VOC) that contaminates the surrounding environment and has an unpleasant smell. Accordingly, the combustible hydrocarbon gas is preferably removed from the air before it is exhausted to the outside of the printer.

As mechanisms to remove such a combustible hydrocarbon gas, there are known a filtering method to physically filter a gas ingredient, a direct combustion method that oxidizes and burns the gas ingredient at a temperature (600–800° C.) above a combustion point of the gas ingredient, a catalyst oxidation method that oxidation decomposes or thermally decomposes the gas ingredient into a water vapor and a carbon dioxide by using a catalyst with chemically burning or oxidizing it at a relatively low temperature (150–400° C.).

FIG. 1 shows a gas exhausting apparatus 10 inhaling air of high temperature including a hydrocarbon gas generated due to evaporation of carrier solution in a printer 1 during a printing operation including fusing or fusing/transferring, removing the hydrocarbon gas from the air of high temperature by the filtering method, and then exhausting the air to the outside of the printer 1.

The gas exhausting apparatus 10 is provided with an exhaust fan 13 inhaling the air in the vicinity of a fusing unit 11 of the printer 1 and exhausting the air to the outside of the printer 1, and a filter 12 disposed between the exhaust fan 13 and the outside of the printer 1 to filter impurities including the hydrocarbon gas in the air. The filter 12 is composed of a dust collecting part 12*a* collecting dust, etc., and an active charcoal 12*b* absorbing and removing the hydrocarbon gas.

Accordingly, as the air inhaled from the inside of the printer 1 by the exhaust fan 13 passes through the filter 12, the hydrocarbon gas therein is absorbed and collected in the active charcoal 12*b*. It is then exhausted to the outside of the printer 1.

However, the gas exhausting apparatus 10 constructed as above has a disadvantage in that the filter 12 should be frequently exchanged in order to maintain its filtering performance, since the active charcoal 12*b* cannot absorb hydrocarbon gas after it is saturated by absorbing large amounts of the hydrocarbon gas over time.

Also, the gas exhausting apparatus 10 presents a safety concern in that a user can be directly exposed to the high temperature air and get burned, since the high temperature air is exhausted to the outside of the printer 1 directly after passing through the filter 12.

To solve these problems, as shown in FIG. 2, there has been proposed a gas exhausting apparatus 10' that inhales air of high temperature including a hydrocarbon gas generated in a printer 1', removes the hydrocarbon gas from the air of high temperature by the direct combustion method, and then exhausts the air to the outside of the printer 1'.

The gas exhausting apparatus 10' includes an exhaust line L forming an air flow path from a fusing unit 11' to the outside of the printer 1', an exhaust fan 40 disposed in the middle of the exhaust line L to inhale and exhaust the air in the printer 1', a combustor 20 heating and chemically burning or oxidizing the air discharged from the exhaust fan 40, a heat exchanger 30 cooling the air heated by the combustor 20, and a dust collecting part 33 removing a dust etc. included in the air.

The combustor 20 includes a heater 21 having a heating temperature of about 1,000–1,300° C. The heater 21 thermally decomposes the hydrocarbon gas in the air that moves along the exhaust line L, thereby to resolve it into a water vapor and a carbon dioxide, and then to exhaust it.

The heat exchanger 30 is provided with a coil tube 31 formed in a spiral shape to increase the moving time of the air, and a cooling fan 32 exchanging heat by blowing air to an outer surface of the coil tube 31 to cool the coil tube 31.

In operation, the hydrocarbon gas in the air inhaled into the combustor 20 by the exhaust fan 40 is thermally decomposed by the heater 21, cooled by the coil tube 31 and the cooling fan 32 of the heat exchanger 30, and then exhausted to the outside of the printer 1' through the dust collecting part 33.

In the conventional gas exhausting apparatus 10', since the hydrocarbon gas is exhausted after being thermally decomposed by the heater 21 and cooled by the coil tube 31 and the cooling fan 32, the disadvantage of frequent exchange of the filter 12 and the safety problem due to direct exhausting of the high temperature air as in the gas exhausting apparatus 10 shown in FIG. 1 are solved.

However, since the conventional gas exhausting apparatus 10' additionally uses the cooling fan 32 and the coil tube 31 to cool the high temperature air as well as the exhaust fan 40, fabrication costs are increased, and structure is complicated, thereby making fabrication difficult.

Also, since the conventional gas exhausting apparatus 10' uses high-priced heater 21 having the heating temperature of about 1,000–1,300° C. to resolve the hydrocarbon gas into the water vapor and the carbon dioxide by thermally decomposing it, fabrication and maintenance costs are increased.

To decrease the heating temperature of the heater 21, as shown in FIG. 3, there has been proposed a gas exhausting apparatus 10" in which a platinum catalyst 22 is disposed around a heater 21 of a combustor 20' to promote oxidation of a hydrocarbon gas generated by printer 1".

However, the gas exhausting apparatus 10" has an advantage in that it can oxidize and thermally decompose the hydrocarbon gas by maintaining a heating temperature of the heater 21 in about 250–300° C., but a problem that fabrication cost and complication in structure are increased due to additional use of a cooling fan 32 and a coil tube 31 of heat exchanger 30 is not still solved.

SUMMARY OF THE INVENTION

It is, therefore, an aspect of the present invention to provide a gas exhausting apparatus of wet electrophotographic image forming device having a relatively simple structure, which is capable of oxidizing and thermally decomposing impurities such as combustible hydrocarbon etc. included in a gas generating when a toner image transferred on a sheet of paper is fused by heat and pressure, and then exhausting the gas.

It is another aspect of the present invention to provide a gas exhausting apparatus of wet electrophotographic image forming device, which by mixing a purified air of high temperature discharged through an air purification unit to oxidize and thermally decompose impurities such as combustible hydrocarbon etc. with an inner air of room temperature and then exhausting them to the outside of the printer, can cool the purified air of high temperature without using a separate cooling apparatus, and increase odor removing efficiency of the air purification unit.

It is still another aspect of the present invention to provide a gas exhausting apparatus of wet electrophotographic image forming device, in which to increase life span, an exhaust fan is disposed in an exhaust end of an exhaust guide of discharging a purified air.

Additional aspects and advantages of the invention will be set forth in part in the description which follows and, in part, will be obvious from the description, or may be learned by practice of the invention.

To achieve the above aspects and other advantages, there is provided a gas exhausting apparatus of wet electrophotographic image forming device comprising an exhaust duct forming an air flow passage from the inside to the outside of the printer, an exhaust fan inhaling air from the inside of the printer through the exhaust duct and exhausting air through the exhaust duct to the outside of the printer, and an air purification unit that removes impurities included in the air inhaled by the exhaust fan through the exhaust duct . The exhaust duct includes a first inhalation guide formed to inhale and guide impurity-containing air of high temperature in the printer and having the air purification unit disposed therein to pass the impurity-containing air through the air purification unit, a second inhalation guide formed to inhale and guide non-impurity-containing air of room temperature in the printer, and an exhaust guide formed to communicate with the first and second inhalation guides and having the exhaust fan disposed therein to mix the impurity-containing air and the non-impurity-containing air respectively inhaled through the first and second inhalation guides and then exhaust the impurity-containing air and the non-impurity-containing air to the outside of the printer.

In an embodiment, the first inhalation guide has an inlet disposed with respect to a pressing roller and a heating roller of a fusing unit to inhale the impuritycontained air including a hydrocarbon gas generated due to evaporation of a carrier solution of liquid toner during fusing operation.

The air purification unit may include a combustion part to remove impurities from air passing therethrough by thermally decomposing and oxidizing the impurities by heating and catalyst-oxidizing the air.

The combustion part of the air purification unit comprises a heater that generates heat by an electric power.

The air purification unit further includes an oxidation catalyst part disposed with respect to the heater to promote oxidation of the impurities. At this time, the oxidation catalyst part comprises a catalyst-carrier body formed of one selected from a gamma alumina, a diatomaceous earth and metallic materials, and a catalyst coated on an outer surface of the carrier body and composed of one selected from the group consisting of Pd, Pt, $Co_3O_4$, PdO, $Cr_2O_3$, $Mn_2O_3$, CuO, $SeO_2$, $FeO_2$, $Fe_2O_3$, $V_2O_5$, NiO, Ag, $MoO_3$ and $TiO_2$.

The catalyst-carrier body may be formed to have a plurality of openings arranged in an air flow direction to widely maintain an area coming in contact with the impurities.

The catalyst-carrier body may include a heater receiving portion receiving and fixing the heater.

In order to increase life span, the exhaust fan may be disposed in an exhaust end of the exhaust guide positioned at the lower part of a stream in the air flow direction of the air purification unit.

According to another aspect of the present invention, there is provided a gas exhausting apparatus. The apparatus including: a first inhalation guide that guides impurity-containing high temperature air drawn into the first inhalation guide; an air purification unit that removes impurities from air passing therethrough, the air purification unit being disposed in the first inhalation guide to remove impurities from the impurity-containing high temperature air drawn into the first inhalation guide; a second inhalation guide that guides non-impurity-containing air drawn into the second inhalation guide, the second inhalation guide in communication with the first inhalation guide at a portion downstream of the air purification unit; an exhaust guide in communication with the first and second inhalation guides; and an exhaust unit located at an exhaust end of the exhaust guide that draws air into and through the first and second inhalation guides to the exhaust guide mixes, in at least at portion of the exhaust guide, the air respectively drawn through the first and second inhalation guides, and exhausts the mixture from the exhaust guide to an outside of the exhaust guide by generating a pressure differential between an inside of the exhaust guide and the outside of the exhaust guide.

According to yet another aspect, there is provided a gas exhausting apparatus for use in a device, including: an airflow passage from an inside of the device to an outside of the device, the airflow passage having an exhaust portion, a first branch in communication with the exhaust portion and a second branch in communication with the exhaust portion and the first branch, the first branch having an inlet at an end opposite to the second branch, the second branch having an inlet at an end distal to the exhaust portion; an impurity remover that removes impurities from air, the impurity remover being disposed in the first branch; and an exhaust unit disposed at an end of the exhaust portion distal to the second branch, the exhaust unit drawing first air from with the device into the first branch, through the impurity remover, and into the exhaust portion and drawing second air from with the device into and through the second branch into the exhaust portion, the exhaust unit mixing the first air and second air in at least a part of the exhaust portion and exhausting the mixture to an outside of the device. The first air contains impurities and is hot and the second air is room temperature.

According to still another aspect of the present invention, there is provided a method of exhausting gas from an electrophotographic image forming device of the wet type. The method includes: drawing a gas and surrounding impurity-containing high temperature air from within a printer into a first inhalation guide; removing the impurities in the gas and surrounding high temperature air to yield first non-impurity-containing air; inhaling second non-impurity-containing air from within the device into a second inhalation guide; drawing the first non-impurity-containing air and the second non-impurity-containing air into an exhaust guide; mixing the first and second non-impurity-containing airs in at least a portion of the exhaust guide; and exhausting the mixture out of the device to an outside of the device.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
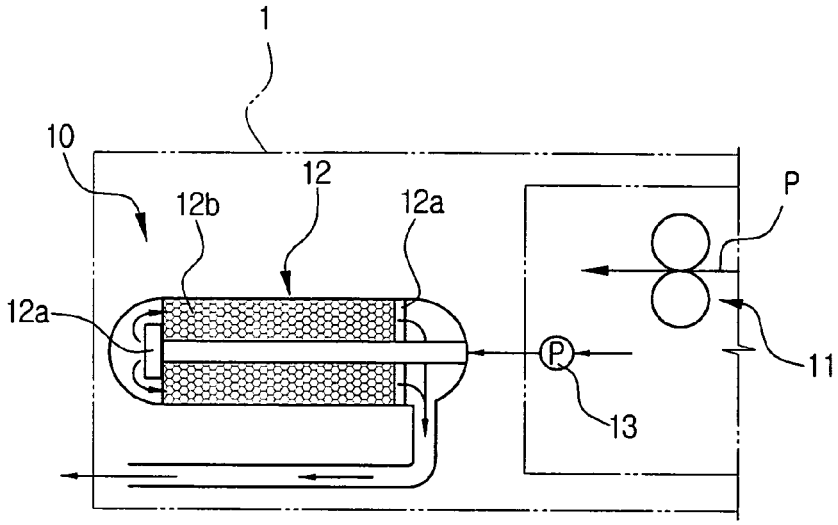
FIG. 1 (PRIOR ART)
FIG. 1 is a schematic front view illustrating a conventional gas exhausting apparatus of wet electrophotographic printer.
Figure 2:
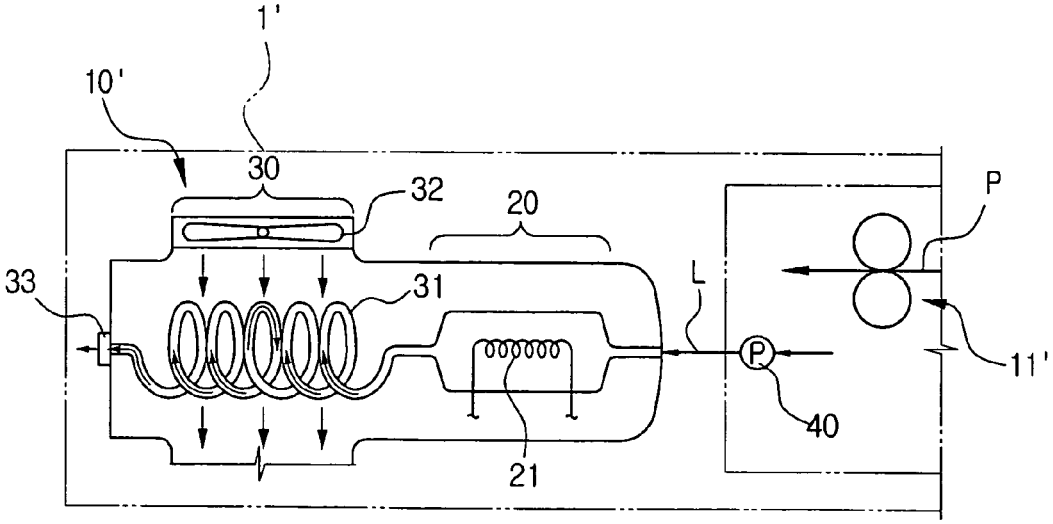
FIG. 2 (PRIOR ART)
FIG. 2 is a schematic front view illustrating another conventional gas exhausting apparatus of wet electrophotographic printer.
Figure 3:
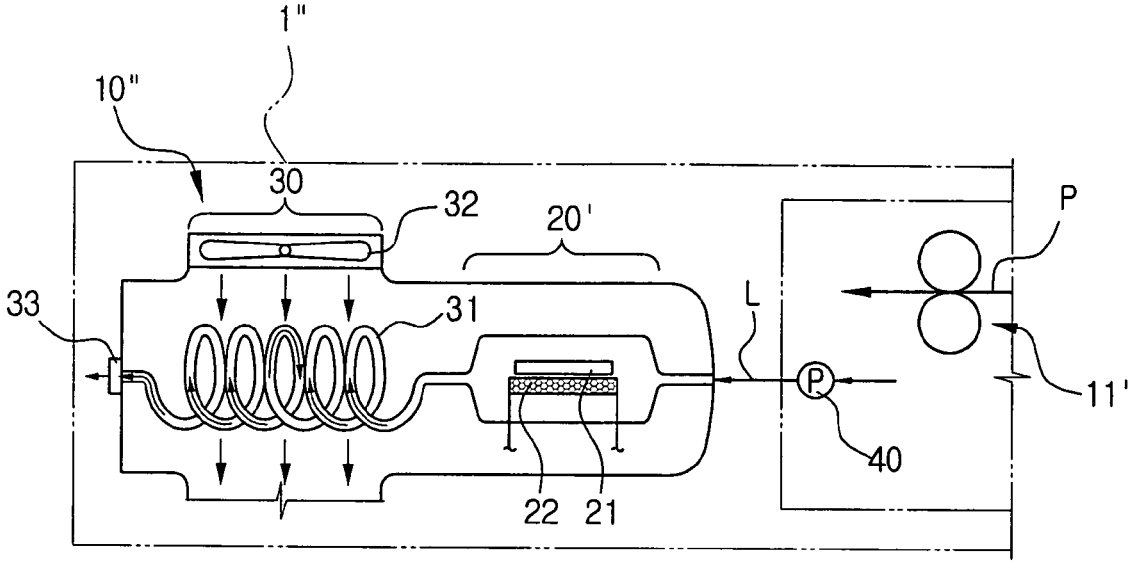
FIG. 3 (PRIOR ART)
FIG. 3 is a schematic front view illustrating still another conventional gas exhausting apparatus of wet electrophotographic printer.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

An embodiment of the present invention will now be described with reference to the accompanying drawings.

Figure 4A:
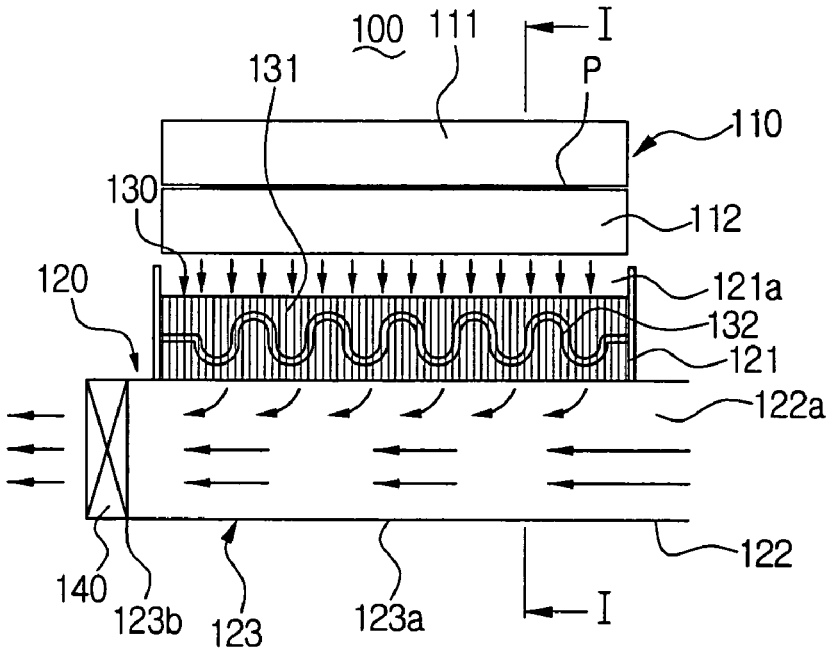
FIGS. 4A and 4B are a schematic front view and a side elevation view taken along line I—I, respectively, illustrating of a gas exhausting apparatus of wet electrophotographic printer in accordance with an embodiment of the present invention.
Figure 4B:
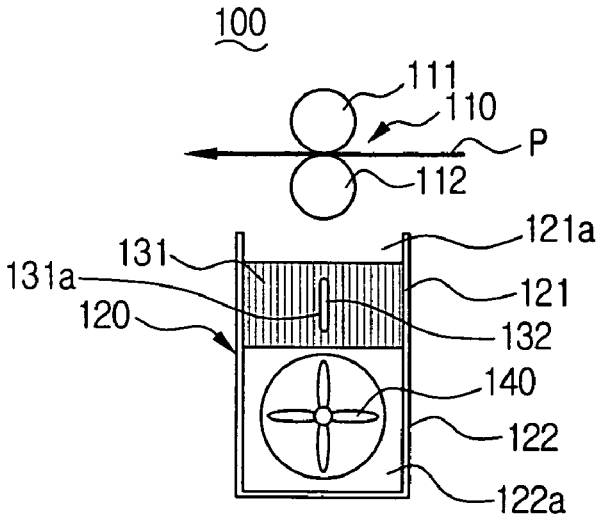

FIG. 4A schematically shows a gas exhausting apparatus 100 of wet electrophotographic printer in accordance with a preferred embodiment of the present invention. FIG. 4B is a side elevation of the apparatus.

The gas exhausting apparatus 100 of the present invention includes an exhaust duct 120 forming an air flow passage from the inside to the outside of the printer, an exhaust fan 140 inhaling air from the inside of the printer through the exhaust duct 120 and exhausting the air through the exhaust duct 120 to the outside of the printer, and an air purification unit 130 having a combustion part 132 that thermally decomposes impurities included in the air inhaled through the exhaust fan 140 by heating and burning the air inhaled through the exhaust duct 120 to remove the impurities.

The exhaust duct 120 comprises a first inhalation guide 121 formed to inhale and guide impurity-containing air of high temperature in which includes impurities such as a combustible hydrocarbon gas etc. generating from a carrier solution of hydrocarbon system in a toner image by a hot heat when it is fused or transferred/fused by a pressing roller 111 and a heating roller 112 of a fusing unit 110 during fusing or transferring/fusing operation, and having the air purification unit 130 disposed therein to pass the impurity-containing air through the air purification unit 130; a second inhalation guide 122 formed separately from the first inhalation guide 121 to inhale and guide non-impurity-containing air of room temperature in which does not include the impurities such as the combustible hydrocarbon gas etc. in the printer, and not to pass the non-impurity-containing air through the air purification unit 130; and an exhaust guide 123 formed to communicate with the first inhalation guide 121 and the second inhalation guide 122, and having the exhaust fan 140 disposed therein to mix the impurity-containing air and the non-impurity-containing air respectively inhaled through the first and second inhalation guides 121 and 122 and then exhaust the impurity-containing air and the non-impurity-containing air to the outside of the printer.

The first inhalation guide 121 has a first inlet 121*a* disposed adjacent to the pressing roller 111 and the heating roller 112 of the fusing unit 110 to inhale the impurity-containing air including the combustible hydrocarbon gas etc. that generates due to evaporation of the carrier solution of the toner image during fusing or transferring/fusing operation, whereas the second inhalation guide 122 has a second inlet 122*a* disposed apart from the fusing unit 110 to inhale the non-impurity-containing air of room temperature in the printer.

The exhaust guide 123 has a mixing portion 123*a* mixing the impurity-containing air of high temperature and the non-impurity-containing air of room temperature respectively inhaled through the first and second inlets 121*a* and 122*a* of the first and second inhalation guides 121 and 122, and an exhaust end 123*b* exhausting the mixed air to the outside of the printer.

In order to increase life span, the exhaust fan 140 is disposed in the exhaust end 123*b* of the exhaust guide 123 positioned at the lower part of a stream in an air flow direction of the air purification unit 130, in which the impurity-containing air of high temperature purified through the air purification unit 130 is mixed and exhausted with the non-impurity-containing air of room temperature.

The combustion part 132 of the air purification unit 130 includes a heater generating heat by an electric power, which is received and supported in a heater receiving portion 131*a* of an oxidation catalyst part 131 to be described later.

The combustion part 132 is formed in a zigzag shape to maximize the surface area coming into contact with the hydrocarbon gas, and to thereby improve the transfer of heat thereto, and has a heating temperature of 150–400° C.

As illustrated in FIG. 4A, the heater 132 is formed in a zigzag shape, but it is to be understood that it may be formed of any other shape, for example a spiral or linear shape to, for example, transfer heat to the hydrocarbon gas well or to be easily fabricated.

The air purification unit 130 of the present invention further includes an oxidation catalyst part 131 disposed in the first inhalation guide 121 to receive and fix the heater 132. The oxidation catalyst part 131 functions to promote oxidation of the hydrocarbon gas to secure the hydrocarbon gas to be thermally decomposed by heat generated from the heater 132.

The oxidation catalyst part 131 comprises a catalyst-carrier body including a gamma alumina, a diatomaceous earth or metallic materials, and a catalyst coated on an outer surface of the catalyst-carrier body and composed of one selected from the group consisting of Pd, Pt, $Co_3O_4$, PdO, $Cr_2O_3$, $Mn_2O_3$, CuO, $SeO_2$, $FeO_2$, $Fe_2O_3$, $V_2O_5$, NiO, Ag, $MoO_3$ and $TiO_2$.

The catalyst-carrier body is formed by sintering powders of the gamma alumina, the diatomaceous earth, or the metallic materials through a press. Preferably, the catalyst-carrier body is formed to have a plurality of openings, each of which has a cross-section of a lattice, hive or circle shape arranged in the air flow direction to widely maintain an area coming in contact with the hydrocarbon gas.

The oxidation activity of the catalyst on the hydrocarbon gas such as, for example methane ($CH_4$) is in descending order $Pd>Pt>Co_3O_4>PdO>Cr_2O_3>Mn_2O_3>CuO>SeO_2>FeO_2>Fe_2O_3>V_2O_5>NiO>Ag>MoO_3>TiO_2$. However, Pd has a weak endurance to catalytic poison, whereas $Co_3O_4$, $Cr_2O_3$ etc. have a disadvantage that the activity is weak. Accordingly, Pt is preferable because as the catalyst coated on the outer surface of the catalyst-carrier body the activity, the thermal resistance, and the anticatalytic poison property are superior.

Also, the catalyst-carrier body of the oxidation catalyst part 131 includes a heater receiving portion 131*a*, which is longitudinally extended along the heater 132 to receive and support the heater 132. The heater receiving portion 131*a* is formed in a shape of elongated opening.

In both FIGS. 4A and 4B, reference numeral P denotes a sheet of paper that passes through the fusing unit 110.

The operation of the gas exhausting apparatus of wet electrophotographic printer constructed of the present invention as above will be explained with reference to FIGS. 4A and 4B.

First, according to a print command, a developing unit (not shown), a transfer unit (not shown), the fusing unit 110, and the exhaust fan 140 and the heater 132 of the gas exhausting apparatus 100 in the printer are operated to carry out a series of image forming processes.

Accordingly, the pressing roller 111 and the heating roller 112 of the fusing unit 110 fuses a toner image transferred onto a sheet of paper P through the image forming processes by high pressure and hot heat, thereby to fix the toner image on the sheet of paper P. As a result, a carrier solution of hydrocarbon system included in the toner image is evaporated to generate a combustible hydrocarbon gas.

The hydrocarbon gas generated from the carrier solution is inhaled into the first inhalation guide 121 through the first inlet 121*a* by the exhaust fan 140, together with surrounding high temperature air heated by the high heat generated from the pressing roller 111 and the heating roller 112. The "high temperature" or "hot" air is warmer than ambient or room temperature air.

The hydrocarbon gas-contained high temperature air inhaled into the first inhalation guide 121 comes in contact with the oxidation catalyst part 131. When the hydrocarbon gas-contained air of high temperature inhaled into the first inhalation guide 121 comes into contact with the oxidation catalyst part 131, the hydrocarbon gas is oxidized and thermally decomposed as the following chemical equation (1) by a heat of 150–400° C. generated from the heater 132:

$$C_nH_{2n}+(m+n/2)O_2 \rightarrow mCO_2+nH_2O+\text{calorie}(200\text{–}300^\circ\text{C.}) \quad (1)$$

The result of this oxidation and thermal decomposition is high temperature air including water vapor and carbon dioxide. Purified air of high temperature including a water vapor and a carbon dioxide oxidized and thermally decomposed as above passes into the exhaust guide 123 is mixed at the mixing part 123*a* of the exhaust guide 123 with room temperature air in the printer inhaled through the second inlet 122*a* of the second inhalation guide 122. At this time, the room temperature air in the printer cools the purified high temperature air, and also dilutes a part of the hydrocarbon gas which is not decomposed, thereby increasing the air purification rate .

Thereafter, the mixed air is exhausted to the outside of the printer by the exhaust fan 140.

As apparent from the forgoing description, it can be appreciated that in accordance with the present invention, the gas exhausting apparatus of wet electrophotographic printer has a relatively simple structure, and provides an effect that can oxidize and thermally decompose impurities such as combustible hydrocarbon etc. included in a gas generating during fusing operation and then exhaust the gas to the outside.

Further, by mixing a purified air of high temperature discharged through an air purification unit oxidizing and thermally decomposing impurities such as combustible hydrocarbon etc. with an inner air of room temperature and then exhausting them to the outside of the printer, the gas exhausting apparatus of the present invention can cool the purified air of high temperature without using a separate cooling apparatus, and can increase the odor removing efficiency of the air purification unit.

Also, the gas exhausting apparatus of the present invention can increase life span of an exhaust fan, since it is disposed in an exhaust end of an exhaust guide of discharging purified air.

While the invention has been shown and described with reference to a certain preferred embodiment thereof, it will be understood by those skilled in the art that various changes in form and details may be made therein without departing from the spirit and scope of the invention as defined by the appended claims.

Although a few embodiments of the present invention have been shown and described, the present invention is not limited to the disclosed embodiments. Rather, it would be appreciated by those skilled in the art that changes and modifications may be made in this embodiment without departing from the principles and spirit of the invention, the scope of which is defined by the claims and their equivalents.

What is claimed is:

1. A gas exhausting apparatus for use in a wet electrophotographic image forming device, the apparatus comprising:

an exhaust duct forming an air flow passage from an inside of a wet electrophotographic image forming device to an outside of the device;

an exhaust fan inhaling air from the inside of the device through the exhaust duct and exhausting the air through the exhaust duct to the outside of the device; and an air purification unit that removes impurities included in the air inhaled by the exhaust fan through the exhaust duct, the air purification unit including a combustion part disposed so that at least a portion of the inhaled air comes into contact with the combustion part, wherein the exhaust duct includes:

a first inhalation guide formed to inhale and guide impurity-containing high temperature air in the device and having the air purification unit disposed therein to pass the impurity-containing air through the air purification unit;

a second inhalation guide formed to inhale and guide non-impurity-containing air of room temperature in the device; and an exhaust guide formed to communicate with the first inhalation guide and the second inhalation guide and having the exhaust fan disposed therein to mix the impurity-containing air and the non-impurity-containing air respectively inhaled through the first inhalation guide and the second inhalation guide and then exhaust the impurity-containing air and the non-impurity-containing air to the outside of the device.

2. The apparatus according to claim 1, wherein the first inhalation guide comprises an inlet disposed proximate to a pressing roller and a heating roller of a fusing unit to inhale the impurity-containing air including a hydrocarbon gas generated due to evaporation of a carrier solution of liquid toner during a fusing operation.

3. The apparatus according to claim 1, wherein the combustion part removes impurities from air by thermally decomposing and oxidizing the impurities by heating the air.

4. The apparatus according to claim 3, wherein the combustion part of the air purification unit comprises a heater that generates heat by an electric power.

5. The apparatus according to claim 4, wherein the air purification unit further comprises an oxidation catalyst part disposed proximate to the heater to promote oxidation of the impurities.

6. The apparatus according to claim 5, wherein the oxidation catalyst part comprises:

a catalyst-carrier body composed of one selected from a gamma alumina, a diatomaceous earth and metallic materials; and a catalyst coated on an outer surface of the catalyst-carrier body and composed of one selected from the group consisting of Pd, Pt, $Co_3O_4$, PdO, $Cr_2O_3$, $Mn_2O_3$, CuO, $SeO_2$, $FeO_2$, $Fe_2O_3$, $V_2O_5$, NiO, Ag, $MoO_3$ and $TiO_2$.

7. The apparatus according to claim 6, wherein the catalyst-carrier body comprises a plurality of openings arranged in an air flow direction to widely maintain an area coming in contact with the impurities.

8. The apparatus according to claim 7, wherein the catalyst-carrier body comprises a heater receiving portion receiving and fixing the heater.

9. The apparatus according to claim 1, wherein the exhaust fan is disposed in an exhaust end of the exhaust guide located downstream of the air purification unit.

10. A gas exhausting apparatus, the apparatus comprising:

a first inhalation guide which guides impurity-containing high temperature air drawn into the first inhalation guide from within the device;

an air purification unit which removes impurities from air passing therethrough, the air purification unit being disposed in the first inhalation guide to remove impurities from the impurity-containing high temperature air drawn into the first inhalation guide by heating at least some of the impurity containing air via contact with a combustion part;

a second inhalation guide which guides non-impurity-containing air of lower temperature than the impurity-containing high temperature air drawn into the second inhalation guide, the second inhalation guide in communication with the first inhalation guide at a portion downstream of the air purification unit;

an exhaust guide in communication with the first and second inhalation guides; and an exhaust unit located at an exhaust end of the exhaust guide which draws air into and through the first and second inhalation guides to the exhaust guide, mixes, in at least at portion of the exhaust guide, the air respectively drawn through the first and second inhalation guides, and exhausts the mixture from the exhaust guide to an outside of the exhaust guide by generating a pressure differential between an inside of the exhaust guide and the outside of the exhaust guide.

11. A gas exhausting apparatus for use in a device, the apparatus comprising:

an airflow passage from an inside of the device to an outside of the device, the airflow passage having an exhaust portion, a first branch in communication with the exhaust portion and a second branch in communication with the exhaust portion and the first branch, the first branch having an inlet at an end distal to the second branch, the second branch having an inlet at an end distal to the exhaust portion;

an impurity remover which removes impurities from air by heating air coming into contact with a combustion part, the impurity remover being disposed in the first branch; and an exhaust unit disposed at an end of the exhaust portion distal to the second branch, the exhaust unit drawing first air from with the device into the first branch, through the impurity remover, and into the exhaust portion and drawing second air from with the device into and through the second branch into the exhaust portion, the exhaust unit mixing the first air and second air in at least a part of the exhaust portion and exhausting the mixture to an outside of the device, wherein the first air contains impurities and is hot and the second air is room temperature.

12. A method of exhausting gas from an electrophotographic image forming device of the wet type, the method comprising:

drawing a gas and surrounding impurity-containing high temperature air from within a printer into a first inhalation guide;

removing the impurities in the gas and surrounding impurity-containing high temperature air to yield first non-impurity-containing air by heating the air and gas coming into contact with a combustion part;

inhaling second non-impurity-containing air from within the device into a second inhalation guide;

drawing the first non-impurity-containing air and the second non-impurity-containing air into an exhaust guide;

mixing the first and second non-impurity-containing airs in at least a portion of the exhaust guide; and exhausting the mixture out of the device to an outside of the device.

* * * * *

UNITED STATES PATENT AND TRADEMARK OFFICE

CERTIFICATE OF CORRECTION

PATENT NO. : 6,996,352 B2
APPLICATION NO. : 10/712319
DATED : February 7, 2006
INVENTOR(S) : Joong-hwan CHOI et al.

It is certified that error appears in the above-identified patent and that said Letters Patent is hereby corrected as shown below:

Column 9, line 65, Claim 10, replace “impurity containing” with --impurity-containing--, therefor.

Signed and Sealed this

Fourth Day of July, 2006

JON W. DUDAS
*Director of the United States Patent and Trademark Office*